United States Patent [19]

Vecera et al.

[11] 4,008,562

[45] Feb. 22, 1977

[54] APPARATUS FOR SUPPLYING A STAPLE FIBER FORMATION TO A FIBER SEPARATING DEVICE OF AN OPEN-END SPINNING UNIT

[75] Inventors: Milos Vecera; Josef Skala; Oldrich Tesar, all of Usti nad Orlici, Czechoslovakia

[73] Assignee: Vyzkumny ustav bavlnarsky, Usti nad Orlici, Czechoslovakia

[22] Filed: June 12, 1975

[21] Appl. No.: 586,400

[30] Foreign Application Priority Data

June 18, 1974 Czechoslovakia ..... 4276/74

[52] U.S. Cl. ..... 57/58.95

[51] Int. Cl.[2] ..... D01H 1/12

[58] Field of Search ..... 57/58.89–58.95

[56] References Cited

UNITED STATES PATENTS

| | | | |
|---|---|---|---|
| 3,360,918 | 1/1968 | Doublebsky et al. | 57/58.95 |
| 3,571,859 | 3/1971 | Doublebsky et al. | 57/58.95 X |
| 3,762,144 | 10/1973 | Didek et al. | 57/58.91 |
| 3,826,071 | 7/1974 | Grau | 57/58.95 X |
| 3,828,539 | 8/1974 | Croasdale et al. | 57/58.91 |

*Primary Examiner*—Donald E. Watkins

[57] ABSTRACT

Apparatus for supplying a staple fiber formation, such as a fibrous sliver, to a fiber separating device in an open-end spinning unit provided with a combing-out cylinder adapted to cooperate with a feed roller and with a pivotally supported pressure shoe thrust toward said feed roller. The apparatus has a pivot shaft supporting the pressure shoe, the pivot shaft carrying a swingably arranged link which is provided with a cutout to receive a guide member, and with stops for stop members provided in an arm carrying the pressure shoe.

The arm is preferably provided with a slit and with a safeguarding member for maintaining the position of the stop members.

2 Claims, 4 Drawing Figures

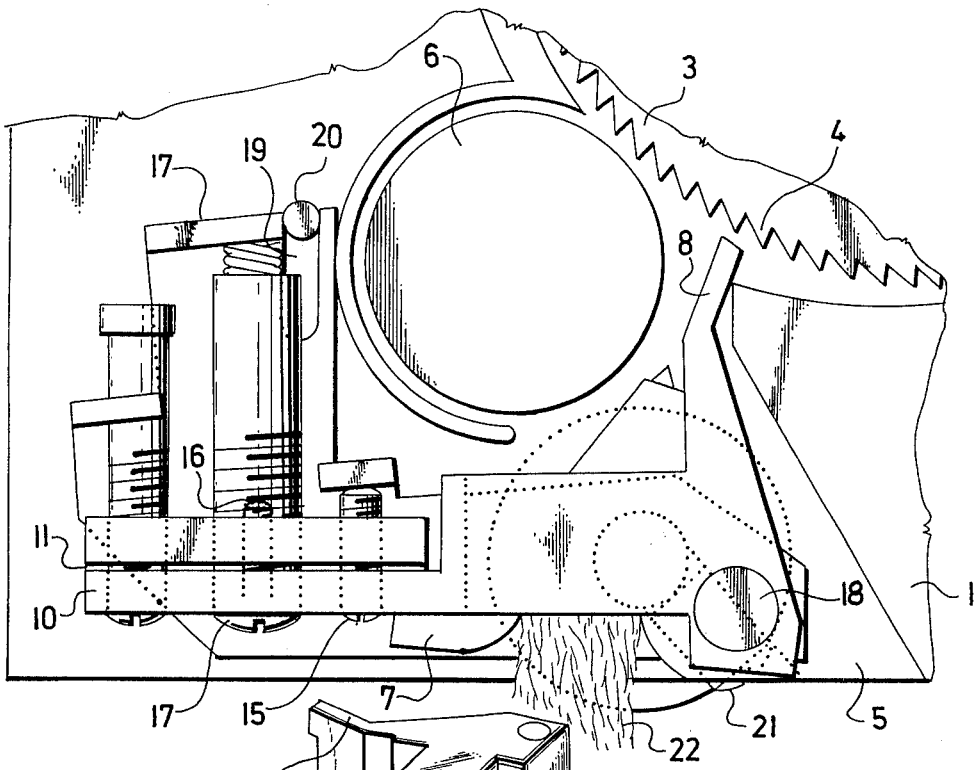
FIG. 3
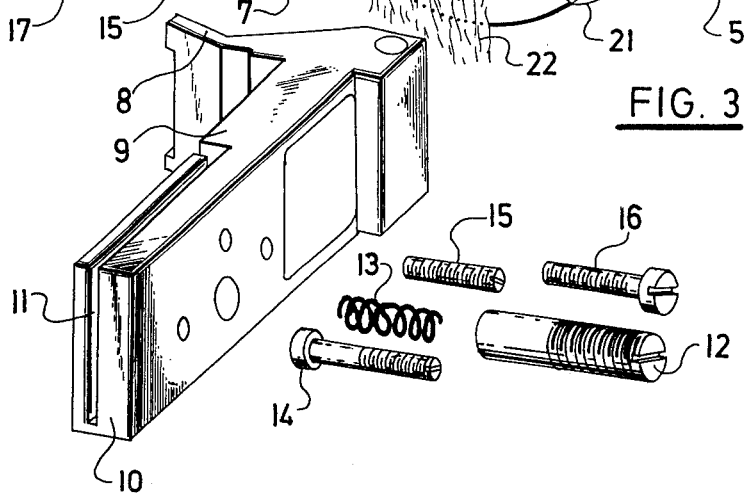
FIG. 4
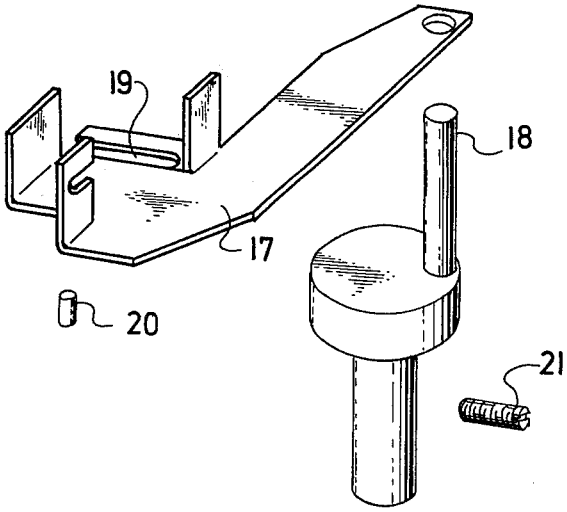

APPARATUS FOR SUPPLYING A STAPLE FIBER FORMATION TO A FIBER SEPARATING DEVICE OF AN OPEN-END SPINNING UNIT

The present invention relates to an apparatus for supplying a staple fiber formation, such as fibrous sliver, to a fiber separating device of an open-end spinning unit. More specifically, the spinning unit is equipped with a combing-out cylinder adapted to cooperate with a feed roller and with a pressure shoe supported to swing about a rotatable eccentrically formed pivot and urged against said feed roller. The apparatus is adapted to maintain the adjusted thrusting force of said shoe and the extreme positions of its swinging movement when readjusting the pressure shoe.

In well-known apparatus comprising a pivoted pressure shoe, wherein the predetermined position of said shoe relative to the combing-out cylinder can be adjusted by turning an eccentrically formed pivot, the thrusting force of the pressure shoe exerted on the feed roller is adjusted by means of adjusting elements adapted to define the limits of the swinging movement of the shoe and to prevent it from being damaged by either the feed roller or the combing-out cylinder.

A disadvantage of such an arrangement lies in the fact that by changing the position of the pressure shoe there are simultaneously provided a change of the thrusting force as well as a change of the position thereof relative to the adjusting elements which define the extreme positions of the pressure shoe; consequently the adjusting elements have to be readjusted after every change of the shoe.

In order to eliminate or at least to mitigate the disadvantages of the prior art, the present invention provides an improved apparatus for supplying a staple fiber formation, such as a fibrous sliver, to the fiber separating device of an open-end spinning unit equipped with a combing-out cylinder adapted to cooperate with a feed roller and a pressure shoe thrust toward the latter. In accordance with the invention the pivot shaft supporting the pressure shoe carries a swingably arranged link which is provided with a cutout to receive a guide member, and is also provided with stops for arresting members provided in an arm carrying the pressure shoe. The arm is provided with a slit and a safeguarding member for maintaining the positions of the arresting members.

An advantage of the apparatus according to the present invention resides in the fact that in case of any change of position of the pressure shoe the thrusting force exerted on the feed roller by the pressure shoe as well as the extreme positions of said shoe remain constant.

In accordance with a preferred embodiment of the invention, the elements for adjusting the urging force and extreme positions of the pressure shoe are all mounted on a common arm, whereby they are prevented from being damaged and loosened.

In order that the present invention may be better understood and put into practice, a preferred embodiment thereof will be hereinafter described with reference to the accompanying drawings which, however, are not intended to limit in any way the scope of the invention.

In the drawings:

FIG. 3 is a view similar to FIGS. 1 and 2, in which the pressure shoe is in its right hand arrested position; and FIG. 4 is a view in perspective of some parts of the apparatus when disassembled.

Figure 1:
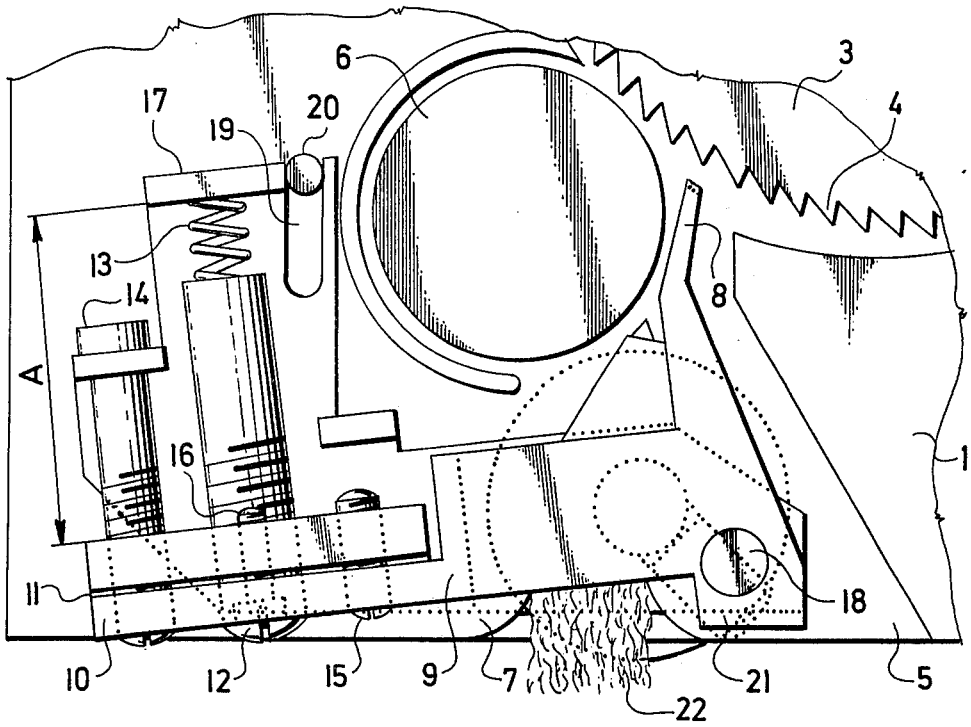
FIG. 1 is a schematic view of the apparatus in the position in which the pressure shoe lies in a left hand arrested position as close as possible to the combing-out cylinder.
Figure 2:
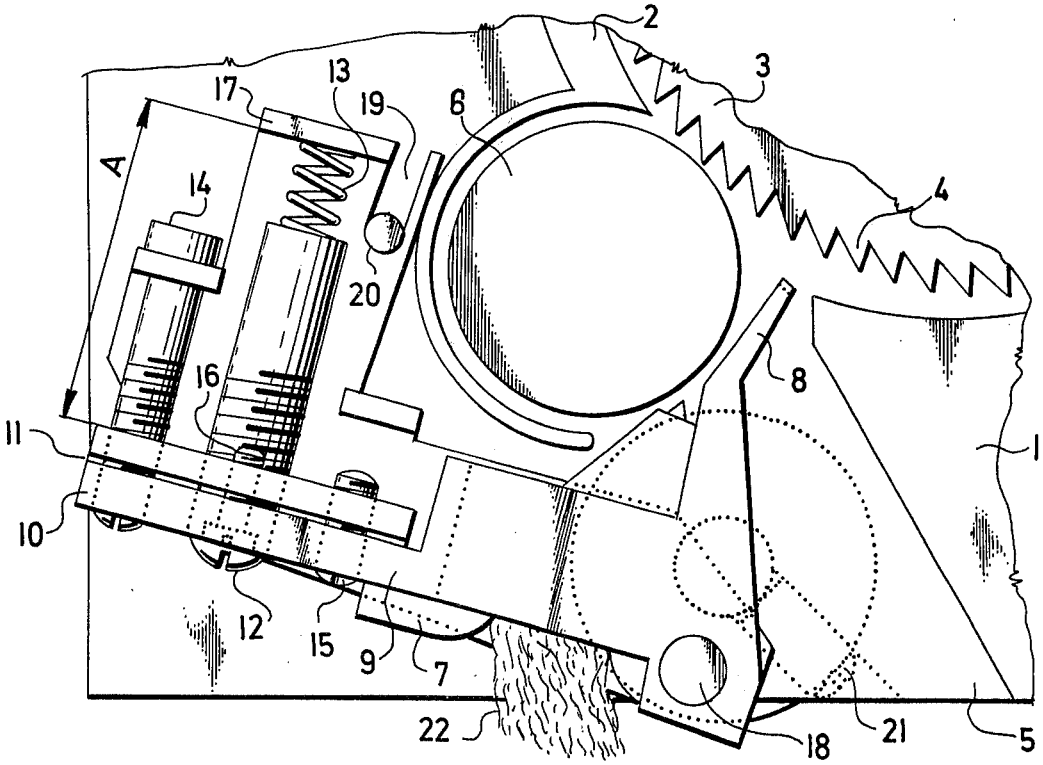
FIG. 2 is a view similar to FIG. 1, wherein the pressure shoe is shown, also in the left hand arrested positions, as distant as possible from the combing-out cylinder.

As is apparent from the drawings, a fiber separating device of an open-end spinning unit is accommodated in a housing 1. In said housing 1 there is provided a circular recess 2 (FIG. 2) in which a fiber separating or opening means in the form of a combing-out cylinder 3 is supported in a conventional manner. The cylinder 3 is provided on its periphery with an appropriate card clothing 4, such as needles or sawteeth. In its lower portion, the circular recess 2 is provided with an intake port 5 accommodating a fiber feeding device constituted by a feed roller 6 adapted to cooperate with the combing-out cylinder 3, a sliver condenser 7 and a pressure shoe 8. The condenser 7 is supported in the pressure shoe 8 by means of a yoke 9. The yoke is extended in an arm 10 provided with a slit 11. A regulating screw 12 bears against a helical spring 13, the screw adjusting the force exerted by the spring upon the pressure shoe 8. A lock screw 14 prevents the pressure shoe 8 from contacting the feed roller 6. Another lock screw 15 is provided for preventing the pressure shoe 8 from contacting the combing-out cylinder 3, and a clamp bolt 16 is provided for preventing the screws 12, 14 and 15 from becoming loosened. the helical spring 13 as well as the lock screws 14 and 15 bear against stops provided on a link 17 which together with the pressure shoe 8, the yoke, and the arm 10 is mounted to swing about an eccentrically formed pivot shaft 18 arrestable in an adjusted position by a screw 21. The link 17 is provided with a cutout 19 adatped to receive a guide member 20. The screws 12, 14 and 15 provided in the arm 10 constitute the elements which provide, by means of the link 17, for the arresting of the pressure shoe on both sides.

The apparatus according to the invention operates as follows:

The requisite distance between the pressure shoe 8 and the card clothing 4 of the combing-out cylinder 3 is adjusted by turning the eccentrically formed pivot shaft 18. The desired force with which the pressure shoe 8 is thrust toward the feed roller 6 can be adjusted by means of the regulating screw 12 and the helical spring 13 bearing against a stop on the link 17.

To prevent the pressure shoe 8 from contacting the feed roller 6 when the device is not supplied with fibrous material such as a sliver 22, and from possibly being damaged, there is provided the lock screw 14, by which the minimum distance between the pressure shoe 8 and the feed roller 6 can be adjusted. The other lock scew 15 serves to limit the swinging of the pressure shoe 8 so as to prevent the latter from contacting the card clothing 4 of the combing-out cylinder 3.

All the adjusting screws 12, 14, and 15 are prevented from being loosened by clamping the slit 11 by means of the clamp bolt 16. If another technological process requires the distance between the pressure shoe 8 and the card clothing 4 of the combing-out cylinder 3 to be changed, the new adjustment of such distance can be performed by turning the eccentrically formed pivot shaft 18 while the previously adjusted pressure force and swing values of the pressure shoe 8 remain unaffected. In the illustrative embodiment, the invariability of the said adjusted values is determined by the position of the guide member 20 and by the shape of the cutout 19 in the link 17. During the shoe adjusting step, the link 17 simultaneously performs both a linear and rotational movement derived from the rotation of the eccentrically formed pivot shaft 18 and limited by the guide member 20.

Although the invention is illustrated and described with reference to one preferred embodiment therof, it is to be expressly understood that it is in no way limited to the disclosure of such a preferred embodiment, but is capable of numerous modifications within the scope of the appended claims.

What is claimed is:

1. In an open-end spinning unit comprising an apparatus for supplying a staple fiber formation to a fiber separating device having a rotatable combing-out cylinder adapted to cooperate with a feed roller and with a pressure shoe mounted on a pivot shaft of said apparatus and biased toward said feed roller, the improvement which comprises, a swingably arranged link mounted on said pivot shaft, said pivot shaft being eccentric, the link being provided with a cutout and stop means, a stationary guide member on said apparatus adapted to be received in the cutout thereby guiding and limiting the swingable movement of said link about said pivot shaft, an arm pivotally mounted on the pivot shaft and carrying the pressure shoe, and stop members mounted on said arm and coacting with said stop means on said link to limit the movement and bias of said pressure shoe relative to said feed roller and said combing-out cylinder.

2. The improvement as claimed in claim 1, wherein the arm is provided with a slit and with a safeguarding member for maintaining the position of the stop members.

* * * * *